United States Patent [19]

Bentvelsen et al.

[11] 4,383,132

[45] May 10, 1983

[54] ELECTRIC HIGH VOLTAGE CABLE

[75] Inventors: Petrus A. C. Bentvelsen, Den Hoorn; Frederik H. Kreuger; Marinus K. Monteny, both of Delft, all of Netherlands

[73] Assignee: N.K.F. Kabel B.V., Netherlands

[21] Appl. No.: 193,209

[22] Filed: Oct. 2, 1980

Related U.S. Application Data

[63] Continuation of Ser. No. 839,621, Oct. 5, 1977, abandoned, which is a continuation of Ser. No. 719,684, Sep. 2, 1976, abandoned, which is a continuation of Ser. No. 510,632, Sep. 30, 1974, abandoned.

[30] Foreign Application Priority Data

Oct. 4, 1973 [NL] Netherlands ..... 7313629

[51] Int. Cl.[3] ..... H01B 1/24; H01B 9/04

[52] U.S. Cl. ..... 174/120 SC; 174/102 SC; 174/106 SC

[58] Field of Search ..... 174/102 SC, 105 SC, 174/106 SC, 120 SC, 47, 127

[56] References Cited

U.S. PATENT DOCUMENTS

| | | | |
|---|---|---|---|
| 2,446,387 | 8/1948 | Peterson | 174/106 SC |
| 3,066,180 | 11/1962 | Virsberg et al. | 174/106 SC |
| 3,290,426 | 12/1966 | Barrentine | 174/47 |
| 3,472,692 | 10/1969 | Isshiki | 174/106 SC |

FOREIGN PATENT DOCUMENTS

| | | | |
|---|---|---|---|
| 532117 | 1/1941 | United Kingdom | 174/127 |

*Primary Examiner*—R. R. Kucia

*Attorney, Agent, or Firm*—Norman N. Spain

[57] ABSTRACT

An electric high voltage cable in which the insulation sheath of the current-conducting cores is provided over the entire cable length on the side remote from the core with a coating of SiC particles embedded in the insulation coating and constituting a voltage-dependent resistive coating.

4 Claims, 1 Drawing Figure

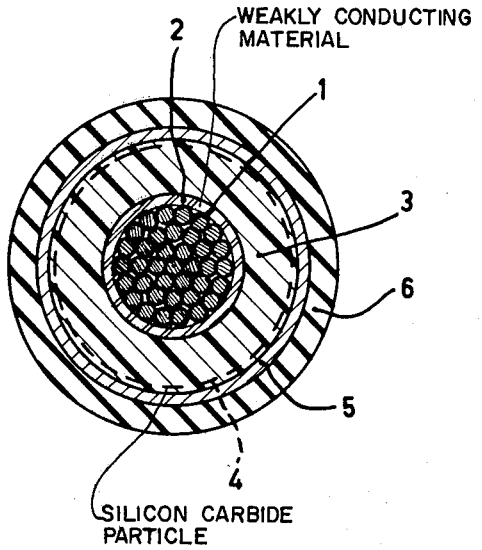
WEAKLY CONDUCTING MATERIAL
2
1
3
6
5
4
SILICON CARBIDE PARTICLE

ELECTRIC HIGH VOLTAGE CABLE

This is a continuation of Ser. No. 839,621, filed Oct. 5, 1977, now abandoned; which in turn was a continuation of Ser. No. 719,684, filed Sept. 2, 1976, now abandoned; which in turn was a continuation of Ser. No. 510,632, filed Sept. 30, 1974, now abandoned.

The invention relates to an electric high voltage cable having one or more conductors each being provided with an insulation coating, the outer side being provided over the entire length with a highly resistive coating whose resistance is voltagedependent. Generally such a cable has a conducting sheath.

A high voltage cable in which the core insulation is provided with a coating of a material having a resistance decreasing with an increasing voltage, generally referred to as voltagedependent may be provided in a simple manner with cable terminations without using field-controlling devices for example in the form of stress-cones. To this end the conducting sheath need only be removed from the end of the cable over a given distance depending on the voltage used. Due to the presence of the voltagedependent resistive coating the occurrence of voltage gradients which might result in corona discharges is automatically prevented.

To this end it is known to wind a tape comprising voltage-dependent resistive material about cable ends after removal of the conducting coating. It has also been proposed to coat the insulating coating of the cable cores over the entire length on the outer side with a suspension of pulverulent voltage-dependent resistive material such as silicon carbide in a solution of a lacquer binder.

Such a cable has the advantage that immediately after removal of the conducting coating cable termination can be provided. In practice it has, however, been found that difficulties may occur both when manufacturing and when using this cable. For example, it is substantially inevitable that inhomogeneities occur in the laquer coating because the voltage-dependent resistive material in the lacquer has a tendency to sag both before and after it has been provided. Furthermore it has been found to be particularly difficult to find a lacquer binder which has a sufficient and permanent adhesion to the conventional core insulation material such as polyethylene and polypropylene also after repeated bending of the cable. For the envisaged object, namely the prevention of voltage gradients which result in corona phenomena a homogeneous distribution of the voltage-dependent resistive material over the insulation and a permanent adhesion to this insulation is necessary.

It is an object of the invention to provide a cable which satisfies these requirements to a large extent.

According to the invention a cable satisfying this object is characterized in that the highly resistive coating consists of particles of a voltage-dependent resistive material which is at least partly and homogeneously distributed and embedded in the surface layer of the core insulation.

A cable according to the invention may be obtained in a simple manner by contacting the core insulation at least superficially softened by means of heating with particles of a voltage-dependent resistive material having a sufficient kinetical energy to penetrate at least partly the softened surface, for example, by using a fluidized bed coating method. It is alternatively possible to heat the particles at a temperature above the softening point of the synthetic resin constituting the insulating coating on the conductors and to contact it with the insulation coating.

The particles of the voltage-dependent resistive material may be entirely or partly embedded in the outside surface of the insulation. For obtaining the envisaged effect it is found to be unnecessary for them to touch each other.

The invention is particularly based on the observation that the build-up of voltage gradients which may result in corona discharges can be adequately prevented by means of a coating of slight thickness of voltage-dependent resistive material.

For example, silicon carbide may be used as a voltage-dependent resistive material. Alternatively boron carbide having voltage-dependent resistive properties can be used.

Satisfactory results are obtained, for example, with a cable in which the dimensions of the silicon carbide particles are between approximately 20 and 200 micrometers and in which per sq. cm of the surface coating of the core insulation a quantity of of 10 to 20 mg of silicon carbide is present. Under these circumstances a coating is obtained which generally has a thickness which is not larger than the largest particle size. It was found that such a coating thickness is sufficient for the envisaged object, for the properties of the coating are not essentially improved in case of larger coating thicknesses. Tests have provided that in a synthetic resin insulated cable of the 8.7/15 KV type in which the metallic conductor shield was removed over a distance of 15 cms from the insulation with a silicon carbide coating embedded in the surface coating did not show any corona phenomena under voltage.

The sole FIGURE in the accompanying drawing shows in a cross-section a high voltage cable having a single core according to the invention.

A conductor shield 2 of weakly conducting material is provided about a core 1 of wound copper wires as well as an insulation coating 3 of polyethylene whose surface is provided with essentially a monograin coating 4 of embedded silicon carbide particles whose resistance is voltage dependent. This assembly is surrounded by a conducting coating 5 of copper strip and an insulation sheath 6 of polyethylene.

What is claimed is:

1. An electric high voltage corona-resistant cable having at least one current conducting core, said core being surrounded along its entire length with an electrically insulating covering, and embedded in the surface of said covering remote from said core, a monolayer of homogeneously distributed particles of a voltage-dependent resistive material selected from the group consisting of silicon carbide and boron carbide, the size of each of said particles being approximately 20 to 200 u and from 10 to 20 mg of said particles being present per sq. cm. of said surface.

2. The high voltage cable of claim 1 wherein the voltage-dependent resistive material is silicon carbide.

3. The high voltage cable of claim 1 wherein the voltage dependent resistive material is boron carbide.

4. An electric high voltage cable as claimed in claim 1, characterized in that the particle diameter is 0.1 mm at a maximum.

* * * * *